US012791271B2

(12) United States Patent
Gomez

(10) Patent No.: US 12,791,271 B2
(45) Date of Patent: Nov. 10, 2026

(54) BOLT CARRIER AND BOLT FOR GAS OPERATED FIREARMS

(71) Applicant: LWRC International LLC, Cambridge, MD (US)

(72) Inventor: Jesus S. Gomez, Trappe, MD (US)

(73) Assignee: LWRC International LLC, Cambridge, MD (US)

( * ) Notice: Subject to any disclaimer, the term of this patent is extended or adjusted under 35 U.S.C. 154(b) by 0 days.

(21) Appl. No.: 19/026,046

(22) Filed: Jan. 16, 2025

(65) Prior Publication Data

US 2026/0002746 A1 Jan. 1, 2026

Related U.S. Application Data

(60) Continuation of application No. 18/520,676, filed on Nov. 28, 2023, now Pat. No. 12,241,708, which is a (Continued)

(51) Int. Cl.

| | |
|---|---|
| ***F41A 15/12*** | (2006.01) |
| ***F41A 3/26*** | (2006.01) |
| ***F41A 3/38*** | (2006.01) |
| ***F41A 3/64*** | (2006.01) |
| ***F41A 5/18*** | (2006.01) |

(Continued)

(52) U.S. Cl.

CPC ..... *F41A 5/24* (2013.01); *F41A 3/26* (2013.01); *F41A 3/38* (2013.01); *F41A 3/64* (2013.01); *F41A 5/18* (2013.01); *F41A 15/12* (2013.01); *F41A 19/06* (2013.01)

(58) Field of Classification Search

CPC ..... F41A 5/18; F41A 5/20; F41A 5/24; F41A 5/12; F41A 3/26; F41A 3/16; F41A 15/14; F41C 23/16

USPC ..... 89/132, 125, 191.01, 138, 193; 42/25, 42/46, 68

See application file for complete search history.

(56) References Cited

U.S. PATENT DOCUMENTS 26,679 A * 1/1860 Hulbert ..... B21D 39/02 30/122
53,496 A * 3/1866 Smith ..... B23C 5/02 407/31

(Continued)

OTHER PUBLICATIONS

U.S. Appl. No. 17/959,956, dated Nov. 7, 2024, Notice of Allowance in the U.S. Patent and Trademark Office.

*Primary Examiner* — Michael D David

(74) *Attorney, Agent, or Firm* — Arnall Golden Gregory LLP

(57) ABSTRACT

An improved bolt and bolt carrier with integral gas key having an extension nozzle threadedly secured and pinned to the gas key for use with a direct gas operated firearm is provided. The extension nozzle is designed to receive a portion of the host firearm's gas operating system. The firing pin retaining pin is oriented so as to expose its widest profile to the firing pin's annular flange, increasing its service life. The bolt has a plurality of lugs extending from its forward end. The extractor recess is constructed so that the face of the bolt is round and the adjacent lugs fully supported. The extractor engages approximately 17% more of a seated ammunition cartridge's rim as compared to the prior art AR15/M16 extractor. The result is an improved bolt and bolt carrier which provides for increased operational reliability.

20 Claims, 20 Drawing Sheets

Related U.S. Application Data continuation of application No. 17/983,324, filed on Nov. 8, 2022, now Pat. No. 11,828,560, which is a continuation of application No. 16/784,058, filed on Feb. 6, 2020, now Pat. No. 11,493,292, which is a division of application No. 15/806,137, filed on Nov. 7, 2017, now Pat. No. 10,598,452, which is a division of application No. 14/575,923, filed on Dec. 18, 2014, now Pat. No. 9,810,495, which is a division of application No. 13/588,294, filed on Aug. 17, 2012, now Pat. No. 8,950,312.

(60) Provisional application No. 61/524,500, filed on Aug. 17, 2011.

(51) Int. Cl.
*F41A 5/24* (2006.01)
*F41A 19/06* (2006.01)

(56) References Cited

U.S. PATENT DOCUMENTS 114,174 A * 4/1871 McConnell et al. .. B05B 7/1404 118/308
368,652 A * 8/1887 Class ..... A63G 11/00 248/371
1,348,733 A * 8/1920 Pedersen ..... F41A 15/14 89/184
1,384,161 A * 7/1921 Schwinzer ..... A47J 43/16 99/494
1,737,974 A * 12/1929 Pedersen ..... F41A 9/70 42/75.01
2,090,656 A * 8/1937 Williams ..... F41A 5/24 89/185
2,336,146 A * 12/1943 Williams ..... F41A 3/72 89/197
2,952,934 A * 9/1960 Yovanovitch ..... F41A 3/06 89/14.05
3,027,672 A * 4/1962 Sullivan ..... F41A 21/12 89/185
3,301,133 A * 1/1967 Sturtevant ..... F41A 19/03 89/131
3,977,296 A * 8/1976 Silsby ..... F41A 3/94 89/198
4,231,177 A * 11/1980 Foote ..... F41C 7/12 42/16
4,246,830 A * 1/1981 Krieger ..... F41A 19/13 89/185
4,279,191 A * 7/1981 Johansson ..... F41A 21/484 89/196
4,416,186 A * 11/1983 Sullivan ..... F41A 3/66 89/198
4,475,437 A * 10/1984 Sullivan ..... F41G 1/08 42/70.06
4,502,367 A * 3/1985 Sullivan ..... F41A 17/16 89/181
4,505,182 A * 3/1985 Sullivan ..... F41A 17/16 42/69.02
4,553,469 A * 11/1985 Atchisson ..... F41A 5/18 42/25
H107 H * 8/1986 Bauer ..... 89/149
4,654,993 A * 4/1987 Atchisson ..... F41G 1/06 42/71.01
4,693,170 A * 9/1987 Atchisson ..... F41G 1/06 89/149
4,893,547 A * 1/1990 Atchisson ..... F41A 3/72 89/187.01
6,182,389 B1 * 2/2001 Lewis ..... F41A 3/26 89/185
6,606,812 B1 * 8/2003 Gwinn, Jr. ..... F41A 21/484 42/75.02
6,761,101 B1 * 7/2004 Luth ..... B25B 1/2457 269/54.5
7,243,453 B2 * 7/2007 McGarry ..... F41A 17/72 42/70.11
7,316,091 B1 * 1/2008 Desomma ..... F41A 3/26 42/16
7,523,580 B1 * 4/2009 Tankersley ..... F41C 23/16 42/71.01
7,735,410 B2 * 6/2010 Clark ..... F41A 15/14 89/138
7,784,211 B1 * 8/2010 Desomma ..... F41A 5/18 42/16
7,806,039 B1 * 10/2010 Gomez ..... F41A 19/47 89/149
7,930,968 B2 * 4/2011 Giefing ..... F41A 3/26 89/185
D641,451 S * 7/2011 Gomez ..... F41A 5/20 D22/108
8,056,460 B2 * 11/2011 Herring ..... F41A 5/18 89/1.4
8,141,289 B2 * 3/2012 Gomez ..... F41C 23/16 42/90
8,206,984 B2 * 6/2012 Roessler ..... C12N 15/79 435/320.1
8,245,427 B2 * 8/2012 Gomez ..... F41A 17/66 89/154
8,342,075 B2 * 1/2013 Gomez ..... F41A 3/66 89/191.01
8,375,616 B2 * 2/2013 Gomez ..... F41A 5/18 42/16
8,387,513 B2 * 3/2013 Gomez ..... F41A 5/20 89/193
8,689,477 B2 * 4/2014 Gomez ..... F41C 23/16 42/72
8,746,125 B2 * 6/2014 Gomez ..... F41A 3/64 89/191.01
8,783,159 B2 * 7/2014 Gomez ..... F41A 5/20 89/193
8,844,424 B2 * 9/2014 Gomez ..... F41A 15/12 89/137
8,887,426 B2 * 11/2014 Feese ..... F16F 1/3605 42/25
8,899,142 B1 * 12/2014 Cassels ..... F41C 23/06 89/198
8,950,312 B2 * 2/2015 Gomez ..... F41A 5/18 42/25
8,966,800 B1 * 3/2015 Olson ..... F41A 15/12 42/25
9,103,611 B2 * 8/2015 Neitzling ..... F41A 3/78
9,234,713 B1 * 1/2016 Olson ..... F41A 9/41
9,347,738 B1 * 5/2016 Schumacher ..... F41A 3/26
9,506,702 B2 * 11/2016 Visinski ..... F41A 9/52
9,658,011 B2 * 5/2017 Gomez ..... F41A 3/16
9,810,495 B2 * 11/2017 Gomez ..... F41A 3/26
9,857,129 B1 * 1/2018 Kelly ..... F41A 3/30
10,309,739 B2 * 6/2019 Gomez ..... F41A 15/14
10,323,891 B1 * 6/2019 Zheng ..... F41A 3/88
10,532,447 B2 * 1/2020 Hamby ..... B25B 23/108
11,067,352 B2 * 7/2021 Gomez ..... F41A 3/26
2008/0092733 A1 * 4/2008 Leitner-Wise ..... F41A 15/14 89/138
2009/0026679 A1 * 1/2009 Harman, III ..... F41C 27/00 269/74
2010/0236394 A1 * 9/2010 Gomez ..... F41A 19/46 89/138
2010/0281734 A1 * 11/2010 Rousseau ..... F41A 3/26 42/25
2010/0313459 A1 * 12/2010 Gomez ..... F41A 17/72 42/70.08
2011/0174148 A1 * 7/2011 Sy ..... F41A 19/04 89/131
2011/0209377 A1 * 9/2011 Davies ..... F41A 5/28 42/16
2011/0220088 A1 * 9/2011 Maggiore ..... F41B 11/68 124/40

(56) References Cited

U.S. PATENT DOCUMENTS

2012/0042557 A1* 2/2012 Gomez ..... F41C 23/16 42/90
2012/0073177 A1* 3/2012 Laney ..... F41C 23/16 42/16
2012/0137556 A1* 6/2012 Laney ..... F41C 23/16 42/6
2012/0137869 A1* 6/2012 Gomez ..... F41A 3/30 89/125
2012/0152105 A1* 6/2012 Gomez ..... F41A 5/20 42/16
2012/0167424 A1* 7/2012 Gomez ..... F41A 35/06 42/14
2012/0260793 A1* 10/2012 Gomez ..... F41A 5/18 89/191.01
2013/0055613 A1* 3/2013 Gomez ..... F41C 23/16 42/90
2013/0152443 A1* 6/2013 Gomez ..... F41A 5/24 42/16
2014/0026744 A1* 1/2014 Gomez ..... F41A 5/20 89/191.01
2014/0033590 A1* 2/2014 Gomez ..... F41A 5/26 42/75.02
2014/0060293 A1* 3/2014 Gomez ..... F41A 35/06 89/1.4
2014/0075817 A1* 3/2014 Gomez ..... F41A 21/48 42/75.02
2014/0076144 A1* 3/2014 Gomez ..... F41A 5/18 42/25
2014/0076146 A1* 3/2014 Gomez ..... F41A 21/00 89/191.01
2014/0090283 A1* 4/2014 Gomez ..... F41A 15/14 42/25
2014/0163664 A1* 6/2014 Goldsmith ..... A61B 17/0057 604/93.01
2014/0230642 A1* 8/2014 Reynolds ..... F41A 3/78 89/130
2014/0259843 A1* 9/2014 Matteson ..... F41A 15/14 42/25
2015/0135942 A1* 5/2015 Gomez ..... F41A 3/26 89/191.01
2015/0260469 A1* 9/2015 Gomez ..... F41A 3/84 89/192
2015/0323269 A1* 11/2015 McGinty ..... F41A 5/24 42/16
2015/0330728 A1* 11/2015 McGinty ..... F41A 3/84 89/198
2016/0047612 A1* 2/2016 Sullivan ..... F41A 5/26 42/25
2016/0370135 A1* 12/2016 Plumb ..... F41A 3/90
2017/0115078 A1* 4/2017 Plumb ..... F41A 3/26
2017/0160027 A1* 6/2017 Gangl ..... F41A 3/70
2017/0321978 A1* 11/2017 Brannan ..... F41A 3/70
2017/0328672 A1* 11/2017 Hewes ..... F41C 23/14
2017/0368652 A1* 12/2017 Chang ..... B23Q 3/005
2018/0066906 A1* 3/2018 Gomez ..... F41A 19/06
2019/0195581 A1* 6/2019 Cassels ..... F41A 3/30
2019/0293379 A1* 9/2019 Taylor ..... F41A 25/12
2020/0096268 A1* 3/2020 Lage ..... F41A 3/66
2020/0240726 A1* 7/2020 Spangler ..... F41A 3/26
2021/0114174 A1* 4/2021 Parra ..... B25B 1/2457
2023/0053496 A1* 2/2023 Gomez ..... F41A 3/26
2023/0304760 A1* 9/2023 Gomez ..... F41A 3/16

* cited by examiner

BOLT CARRIER AND BOLT FOR GAS OPERATED FIREARMS

This application is a continuation of U.S. patent application Ser. No. 18/520,676, filed Nov. 28, 2023, which is a continuation of U.S. patent application Ser. No. 17/983,324, filed Nov. 8, 2022, granted as U.S. Pat. No. 11,828,560, which is a continuation of U.S. patent application Ser. No. 16/784,058, filed Feb. 6, 2020, granted as U.S. Pat. No. 11,493,292, which is a divisional of U.S. patent application Ser. No. 15/806,137, filed Nov. 7, 2017, granted as U.S. Pat. No. 10,598,452, which is a divisional of U.S. patent application Ser. No. 14/575,923, filed Dec. 18, 2014, granted as U.S. Pat. No. 9,810,495, which is a divisional of U.S. patent application Ser. No. 13/588,294, filed Aug. 17, 2012, granted as U.S. Pat. No. 8,950,312, which claims priority to U.S. Provisional Application No. 61/524,500, filed Aug. 17, 2011, the disclosure of each of which is incorporated herein by reference in their entirety.

BACKGROUND OF THE INVENTION

Field of the Invention

The present invention relates to gas-operated firearms and, more particularly, to an improved bolt and bolt carrier for use in such firearms.

Description of the Related Art

The AR15/M16 family of weapons and their derivatives, including all direct gas operated versions, have been in use by the military and civilian population for many years. An essential part of this firearm's design is the bolt carrier which typically includes a bolt mounted in the carrier for axial sliding movement and rotation, a firing pin slidably mounted within the bolt and bolt carrier for restricted reciprocating axial movement, and a cam pin for producing relative rotation between the bolt and the bolt carrier.

The bolt carrier is generally cylindrical in shape with a longitudinally extending circular bore throughout its length. An elongated opening is provided in the top and bottom of the carrier to allow the hammer to extend into the interior of the bolt carrier and strike the firing pin. The rear of the carrier is received within the firearm receiver and the front of the carrier houses the bolt. The upper surface of the carrier immediately adjacent the front face includes a flat shelf for engagement with a charging handle. About the exterior of the bolt carrier are a series of lands and accompanying grooves, usually four, which extend from the forward end of the bolt carrier rearwardly over a distance of about one half the length of the bolt carrier. There are openings on the bolt carrier to mount a gas key, an opening which serves as a gas receiving port and an opening to receive the cam pin. Typically the gas key is secured to the bolt carrier through the use of two screws while the firing pin is retained in place through the use of a retaining or cotter pin.

Like the bolt carrier, the bolt has a body that is generally cylindrical in shape and is provided with a circular bore throughout its length which is designed to accommodate a firing pin. Located radially about a forward portion of the bolt are a series of lugs and an extractor. The exterior of the bolt has a recess provided therein with an extractor bearing surface that houses the extractor. The forward end of the extractor includes a gripping element, or claw, which catches and holds onto the rim of the case head of an ammunition cartridge.

The extractor rotates about a pin received by both the bolt body and the extractor. Located at the rearward end of the extractor is a spring and internal buffer. The extractor spring and buffer press against the extractor bearing surface thereby resisting rotation of the extractor about its axis and facilitates the extraction of a used ammunition cartridge.

Present on the front face of the bolt is an ejector that is located opposite the side of the front face adjacent the extractor. The ejector consists of a spring-loaded pin which is retained in place on the bolt through the use of a roll pin. The ejector assists in pushing an ammunition cartridge away from the bolt face when the firearm is being fired or otherwise unloaded.

The bolt carrier group is responsible for stripping, chambering, locking, firing, extraction and ejection of ammunition cartridges for the host rifle. The energy to perform these functions is provided in the form of hot, expanding gases which travel through the host firearm's gas tube, through the gas key and into the bolt carrier. A secure union between the gas key and bolt carrier is important to the proper operation of a direct gas operated firearm. Should the gas key become loose or be removed, the associated firearm will not properly function due to resulting gas leakage.

As shown in FIG. 1A, the prior art method of attaching a gas key to the bolt carrier relies on two screws which are torqued and then staked in place.

FIG. 1A illustrates a prior art bolt carrier 60 which uses a separate gas key 61 that has an integral nozzle for communicating with the gas tube of the host rifle. The base of the gas key 61 is secured to the bolt carrier 60 through the use of two retention screws 66. The retention screws are inserted through the openings 62 located on the base of the gas key 61 then threaded into the openings 65 located on the top surface of the bolt carrier 60. This method is deficient as the max torque applied to the screws is not sufficient to prevent the screws 66 from becoming threadedly unsecured due to vibration and the heating/cooling cycle of the host rifle during normal operation. The result is gas leakage which decreases the reliability of the host rifle by causing extraction and feeding related malfunctions.

The retaining pin or cotter pin 64 found in the prior art is retained within an opening 63 that provides no method to orient the pin 64. As a result the pin 64 can be placed either by the user, or through rotation during normal use of the rifle, into a position which orients the thinnest profile of the cotter pin towards the firing pin. This deficiency in the prior art reduces the service life of the cotter pin 64 resulting in several critical issues. The cotter pin can become bent such that maintaining the rifle is difficult since the cotter pin should be removed to service the bolt and bolt carrier properly. Removing a bent cotter pin 64 through the provided opening 63 is difficult, often requiring tools such as pliers to accomplish. Once the cotter pin 64 is removed, the user must be able to reinsert the cotter pin 64 back into the opening 63 of the bolt carrier 60. If the cotter pin 64 is bent, this operation is often virtually impossible. The cotter pin 64 can also break or bend sufficiently thereby rendering the rifle inoperable. The terms "cotter pin" and "retaining pin" are used interchangeably herein.

The prior art bolt has several points of deficiency. First, there are seven bolt lugs placed radially about the forward end of the bolt. These lugs are evenly spaced apart except for the gap created on the exterior of the bolt to accommodate the extractor, which gap is referred to herein as the extractor pocket. When the extractor pocket is machined, a portion of the bolt's face is removed, resulting in the case head of the cartridge not being fully supported.

Second, the lugs located on either side of the extractor pocket are not fully supported, rendering them the weakest lugs on the prior art bolt. As such, these two lugs experience the highest rate of failure. Further, the lugs themselves are machined with sharp edges or geometric corners about their exterior. These geometric corners often accumulate material stress which can result in micro fractures that limit the service life of the bolt.

Third, extraction of a spent cartridge by the extractor, extractor spring and buffer can be disrupted due to a variety of conditions including a fouled barrel chamber, an over pressured gas system, an improperly annealed cartridge rim, as well as others. To compensate for this deficiency, various remedies have been developed to include, for example, the use of o-rings which increase the force the extractor is capable of placing on the rim of an ammunition cartridge.

Fourth and fifth, problems persist with the present method of securing the gas key to the bolt carrier using two screws as described above, and with the method by which the cotter pin that retains the firing pin is able to rotate into a structurally weak position. Finally, there is a deficiency in prior art methods of manufacturing the bolt. It would be highly advantageous, therefore, to remedy the foregoing and other deficiencies inherent in the prior art.

SUMMARY OF THE INVENTION

In view of the foregoing, one object of the present invention is to overcome the shortcomings in the design of bolt carriers and bolts for self-loading firearms as described above. Another object of the present invention is to provide a bolt carrier having an integral gas key with a removable nozzle which is constructed to be in communication with a gas tube of the host firearm.

Yet another object of the present invention is to provide a bolt carrier in accordance with the preceding objects in which the nozzle is threadedly secured to the gas key and held in place with a cross pin that relies on tension and the structure of the upper receiver to retain the cross pin in place.

A further object of the present invention is to provide a bolt carrier in accordance with the preceding objects in which the bolt carrier is constructed to orient the cotter pin that retains the firing pin such that the widest profile of the cotter pin is always oriented towards the firing pin.

A still further object of the present invention is to provide a bolt carrier in accordance with the preceding objects which includes a bolt with a fully supported bolt face and an improved structure for incorporation of the extractor.

Another object of the present invention is to provide a bolt carrier in accordance with the preceding objects in which the extractor engages a larger portion of the rim of the cartridge case as compared to prior art extractors.

A still further object of the present invention to provide an improved bolt carrier in accordance with the preceding objects that is not complex in structure and which can be manufactured at low cost but yet increases the reliability and safety of the firearm.

In accordance with these and other objects, the present invention is directed to a direct gas operated firearm of the AR15/M16 variety having an improved bolt carrier assembly. This improved bolt carrier assembly can be retrofitted to an existing direct gas operated AR15/M16 type rifle without the need for any modification to the receiver of the rifle or any other part thereof.

The improved bolt carrier includes an integral gas key which is threaded to receive an extension nozzle which is constructed to receive a portion of the host firearm's gas tube. The extension nozzle is held in place through the use of a cross pin which prevents loosening of the nozzle during use of the firearm.

The present invention also provides an improved bolt carrier that includes a machined structure on the exterior of the bolt carrier which optimally orients the cotter pin that retains the firing pin retaining pin so as to maximize the service life of the cotter pin. In particular, the retaining pin is oriented in a vertical profile so that the widest profile of the retaining pin is always oriented toward the firing pin.

In addition, the improved bolt carrier according to the present invention has a bolt with a fully supported bolt face, eliminating the machining of a gap into the bolt face in order to accommodate an extractor. By fully supporting the bolt face, the lugs located on either side of the extractor pocket are not undercut, resulting in a more durable bolt.

Still further, the present invention includes a bolt carrier with a bolt including an extractor having an extractor claw that grabs or engages approximately 17% more of an ammunition cartridge's rim as compared with prior art extractors. By spreading the forces related to extraction over a larger area of the rim of the cartridge, the likelihood of failed extraction is substantially diminished.

These together with other improvements and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1A:
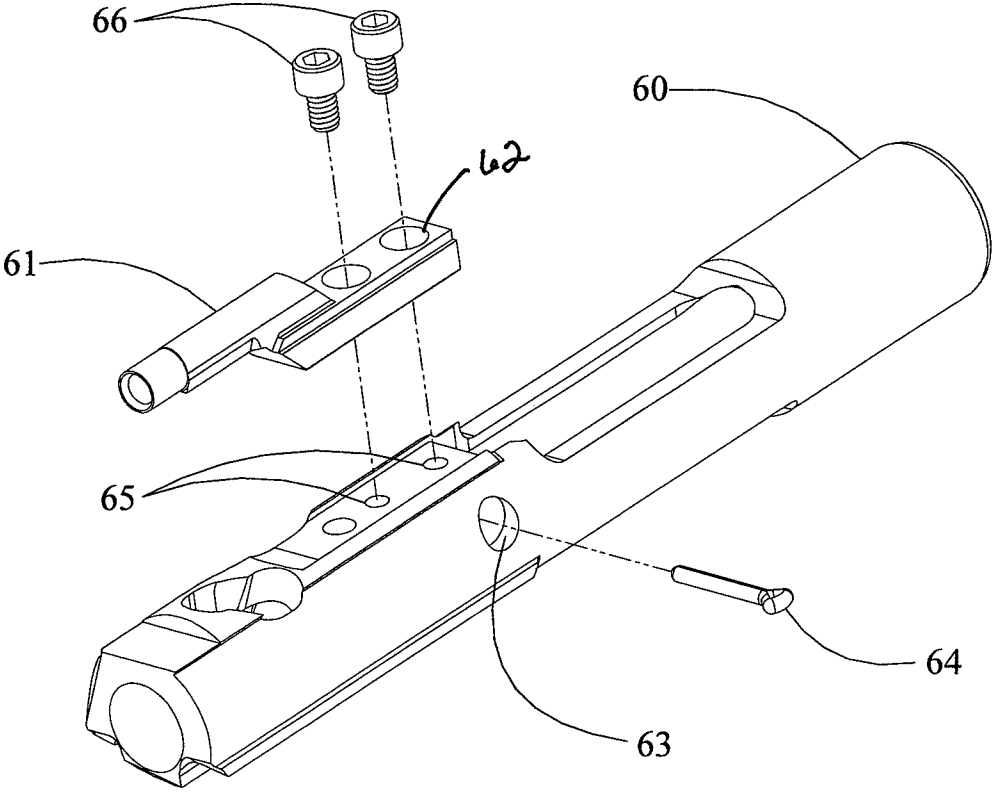
FIG. 1A is a side perspective view of a prior art bolt carrier and gas key.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

The present invention is directed towards a bolt and bolt carrier group or bolt carrier assembly for use with the M4/M16/AR15 family of firearms and their derivatives. As used herein, the phrases "bolt carrier assembly" and "bolt carrier group" are used interchangeably.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose. Unless otherwise specified, the various components which make up the trigger mechanism, upper receiver assembly, lower receiver assembly, buttstock assembly, bolt and bolt carrier assembly are those found on the prior art M4 and M16 family of firearms.

Figure 1B:
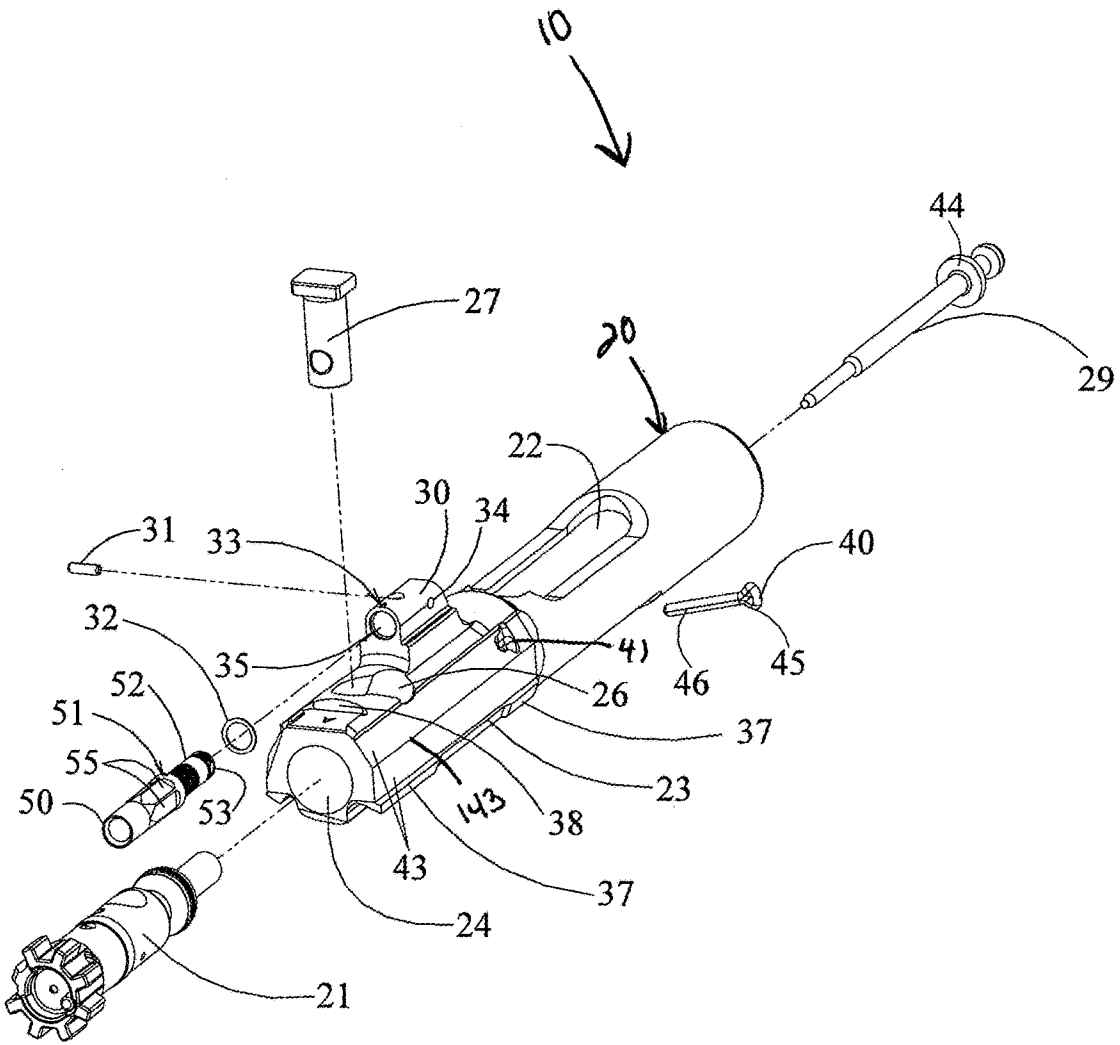
FIG. 1B is an exploded perspective view of a bolt carrier assembly including a bolt carrier, an extension nozzle, and a bolt in accordance with the present invention.
Figure 2:
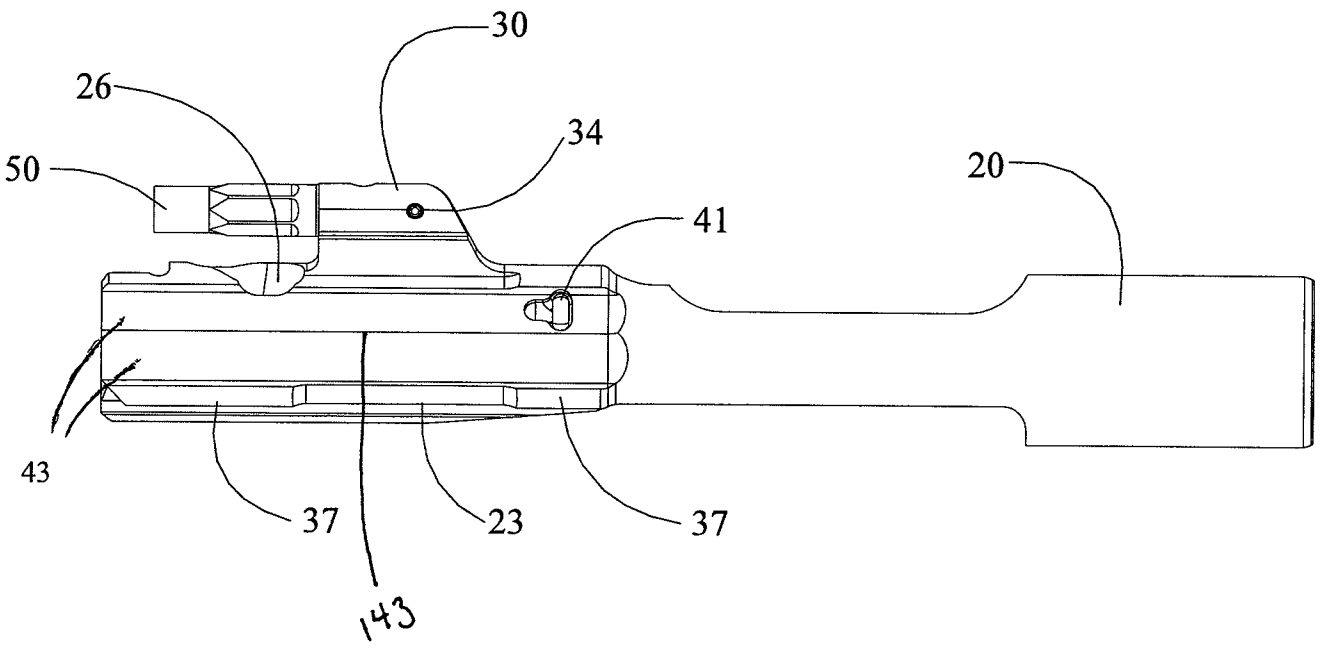
FIG. 2 is a side perspective view of the left side of the bolt carrier included in the bolt carrier assembly shown in FIG. 1B.
Figure 4:
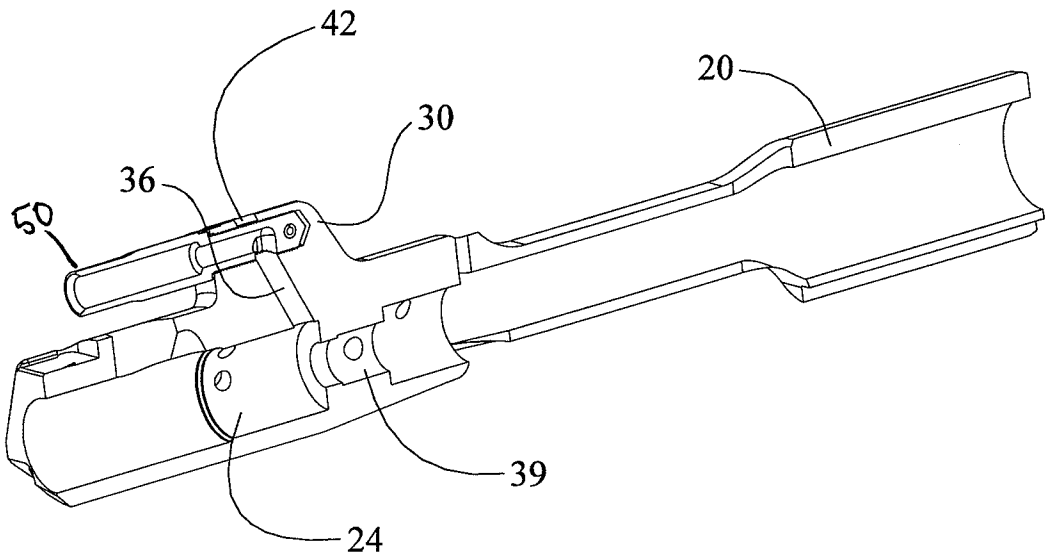
FIG. 4 is a perspective cutaway view of the bolt carrier shown in FIG. 2.

As used herein, "front" or "forward" and "distal" correspond to the end of the bolt carrier 20 where the gas key is located and nearest the muzzle of the firearm (i.e., to the left as shown in FIGS. 1B, 2 and 4); and "rear", "rearward", "back" or "proximal" correspond to the end of the bolt carrier 20 nearest the buttstock of the firearm and opposite the end where the gas key is located (i.e., to the right as shown in FIGS. 1B, 2 and 4).

As shown in FIG. 1B, the present invention is directed to an improved bolt carrier assembly, generally designated by reference numeral 10, including a bolt carrier 20 with an integral gas key 30, a bolt 21 and an extension nozzle 50 coupled to the gas key with a roll pin 31. It will be understood that the bolt carrier assembly 10 is intended to be employed with any of the various direct gas operated M16 type firearms; however with minor modifications, some of its features could be more widely used for other firearms as well. The features of the bolt 21 are capable of being adapted to work with most direct and indirect (piston operated) gas operated firearms. It will also be understood that the bolt carrier assembly 10 is housed within an upper receiver 13, shown in FIGS. 7 and 8, of a M16 type rifle 300.

Figure 3:
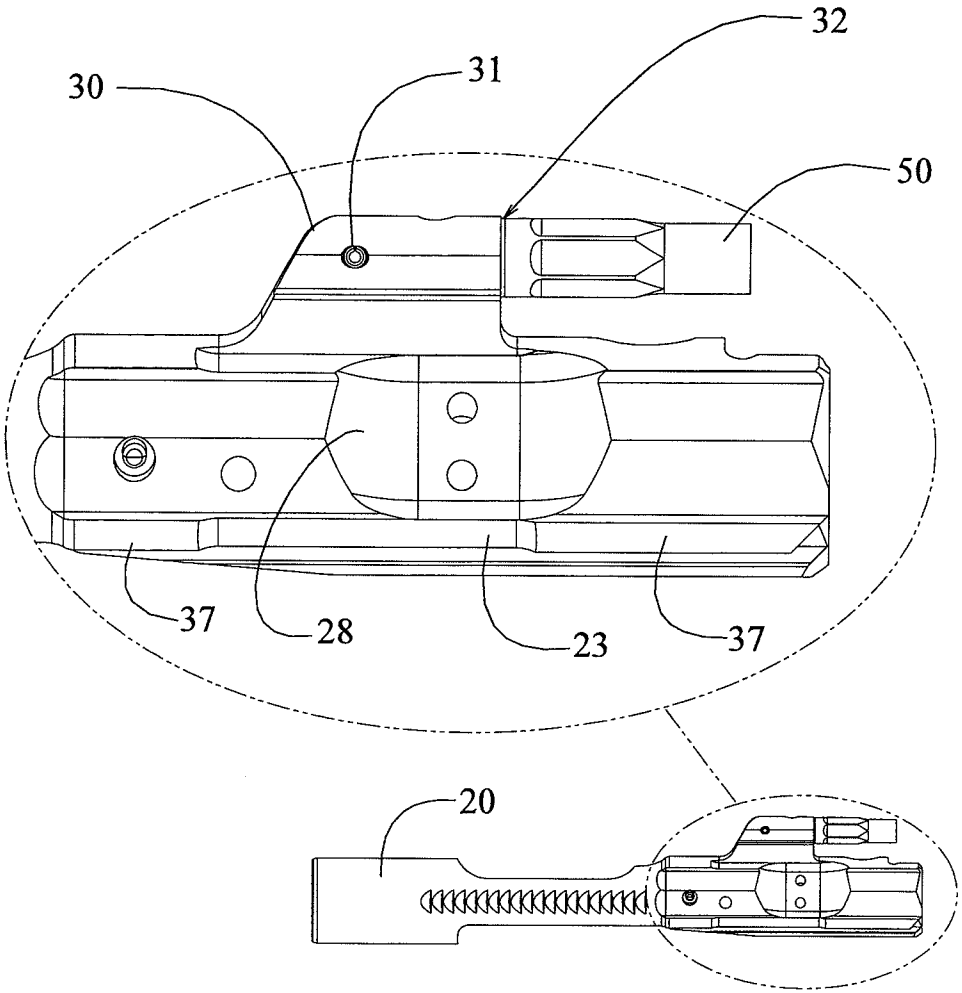
FIG. 3 is a side perspective view of the right side of the bolt carrier shown in FIG. 2.

As shown in the exploded view of the bolt carrier assembly 10 provided in FIG. 1B, and the isolated views of the bolt carrier 20 shown in FIGS. 2-4, the integral gas key 30 is located on the top surface of the bolt carrier 20. The gas key 30 has an opening 34 at its rearward end for the roll pin 31, and a threaded opening 35 at its front end which interfaces with a threaded member 52 on the extension nozzle 50 as will be described more fully hereinafter. Horizontal side views of the bolt carrier 20 shown with the extension nozzle 50 threadedly retained in place and secured with the roll pin 31 are provided in FIGS. 2 and 3. The front end of the gas key 30 also has an indexing notch 33 that is used to orient the extension nozzle as will also be described more fully hereinafter.

FIG. 4 shows a cutaway view of the preferred embodiment bolt carrier 20 with the extension nozzle 50. An opening 42 is machined into the top exterior of the gas block, through to the interior opening 24 for the bolt 21. The through bore created by the machining process is generally referred to herein as a port 36. The port 36 is angled along its length and allows for the flow of expanding gases to pass from the gas key 30 into the opening 24 behind the bolt 21, thereby facilitating the operation of the rifle 300.

Figure 9:
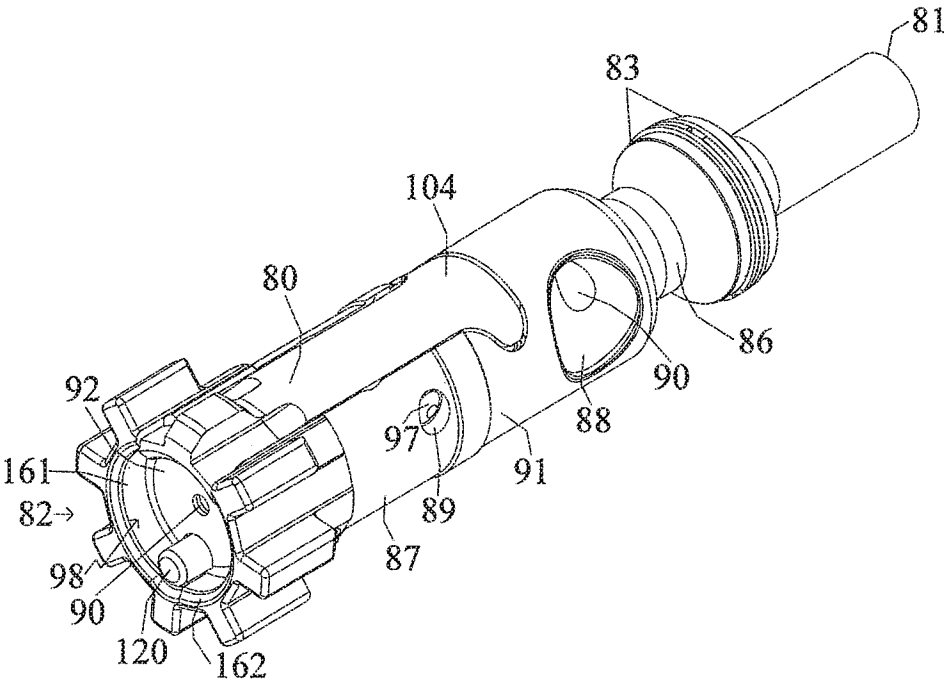
FIG. 9 is a side perspective view of the bolt included in the bolt carrier assembly shown in FIG. 1B.
Figure 10:
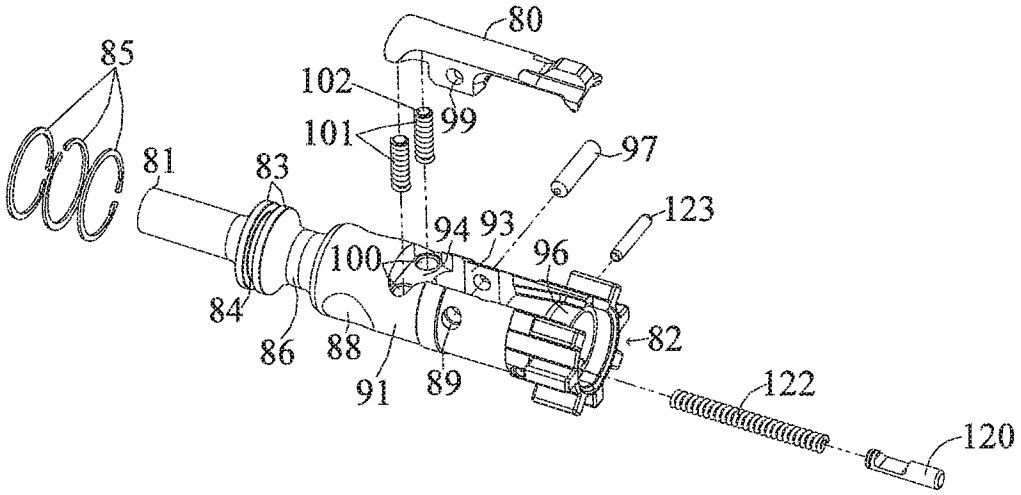
FIG. 10 is an exploded perspective view of the bolt shown in FIG. 9.
Figure 11:
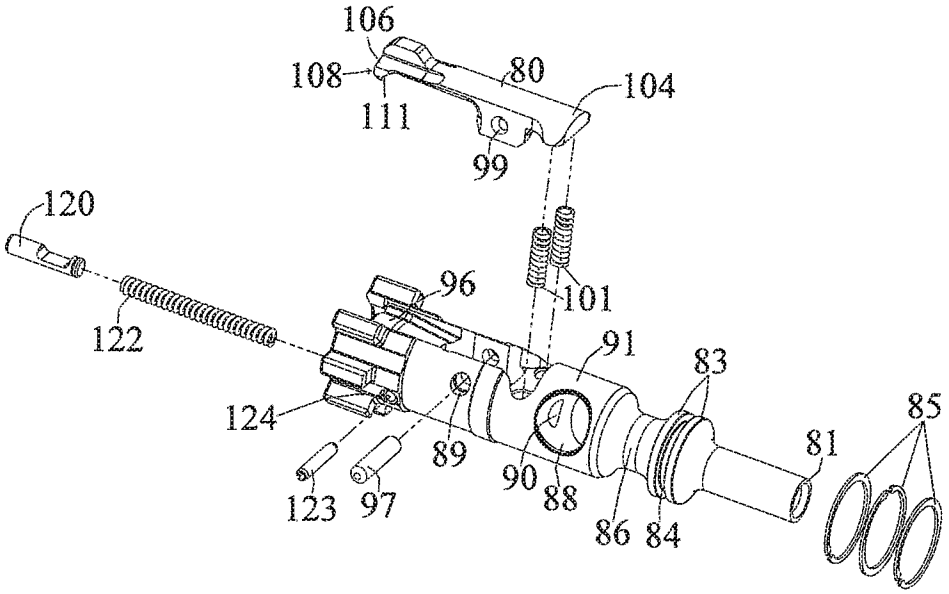
FIG. 11 is an exploded view of the bolt shown in FIG. 10 rotated 180 degrees.
Figure 12:
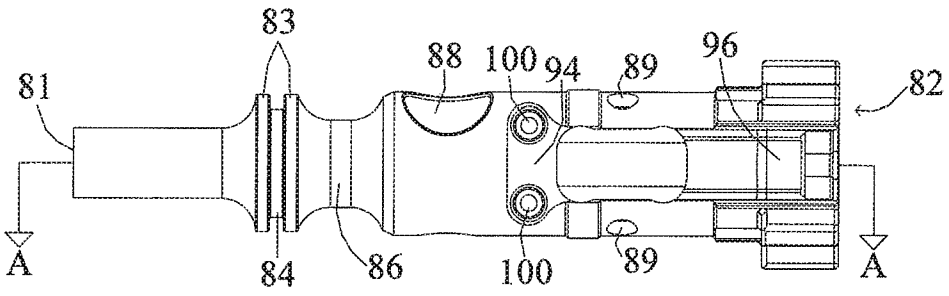
FIG. 12 is a side view of the bolt shown in FIG. 9.
Figure 13:
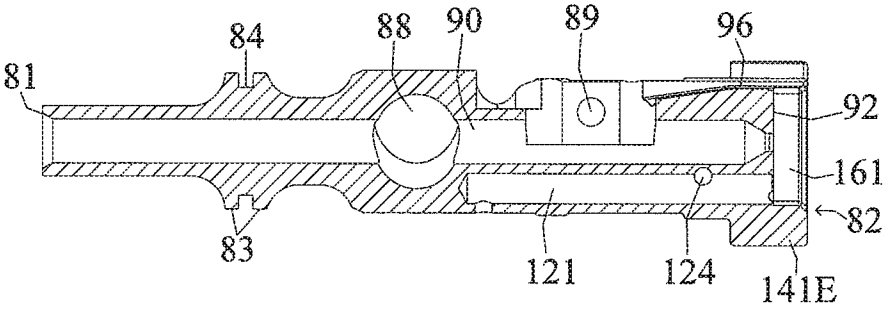
FIG. 13 is a cross sectional view of the bolt shown in FIG. 12.

Also present on the bolt carrier 20 is a hammer clearance slot 22, which permits the hammer (not shown) to extend into the bolt carrier 20 and strike a firing pin 29. An opening 41 for a cotter pin 40 and an opening 24 for a bolt 21 (shown in FIGS. 1B and 9) are also provided within the bolt carrier.

FIGS. 1B and 2 show the opening 41 designed to contain the cotter pin 40. The cotter pin 40, also referred to as a retaining pin, is installed after the firing pin 29 is placed within the interior of bolt carrier 20. The sole purpose of the cotter pin 40 is to retain the firing pin 29 within the bolt carrier 20. The opening 41 is part of a bore which runs through the bolt carrier 20, perpendicular to the longitudinal axis thereof. The bore connected to the opening 41 is constructed to accommodate the tail portion 46 of the cotter pin 40. One end of the opening 41 is constructed to hold the head 45 of the cotter pin 40 in a vertical orientation as shown in FIG. 1B, thereby orienting the widest profile of the tail portion 46 towards the firing pin's 29 annular flange 44. From an external view, the opening 41 about the exterior of the bolt carrier 20 is approximately "T" shaped. As seen best in FIG. 2, the vertical portion of the opening 41 is for receiving the head 45 portion of the cotter pin 40. The horizontal portion of the opening 41 is to facilitate the insertion of a tool, such as a small screw driver, bullet tip, pliers or their equivalent, to aid in the removal of the cotter pin 40. By orienting the cotter pin 40 in this manner, the widest profile of the cotter pin 40 is oriented towards the rearward side of the annular flange 44 located near the back end of the firing pin 29. This orientation with the largest profile of the cotter pin 40 facing the annular flange 44 of the firing pin 29 makes the cotter pin 40 better able to resist metal fatigue which reveals itself as the bending or breakage of the part. It should be understood that in alternate embodiments the opening 41 could be oriented to have an external appearance such as an "X", a "+", or other equivalent shapes and structures, so long as the cotter pin 40 is being oriented to expose the largest cross section of the tail portion 46 towards the annular flange 44 of the firing pin 29 and prevent the cotter pin 40 from unnecessarily rotating.

The opening 24 in the bolt carrier 20 for the bolt 21 includes a longitudinal bore which extends from the forward end of the bolt carrier 20 rearwardly for a distance sufficient to accommodate the rearward portion of the bolt 21. A smaller bore 39 (see FIG. 4) continues for a further distance to accommodate the rear end 81 of the bolt 21. The top of the bolt carrier 20 immediately adjacent the front face thereof has a charging handle contact point 38 which facilitates manual operation of the host rifle 300.

Located rearwardly of the charging handle contact point 38 is a cam slot 26 which provides a contained area for the cam pin 27 to rotate, thus allowing the bolt 21 to move rearward and rotate axially within the bolt carrier 20. The cam pin 27 retains the bolt 21 within the bolt carrier 20.

The bolt carrier 20 is also provided with a series of bearing surfaces 37. These bearing surfaces 37 are located on the front half, top and bottom sides of the bolt carrier 20, and are in direct contact with the interior of the upper receiver 13. The bearing surfaces 37 located along the bottom portion of the bolt carrier 20 are interrupted along there length by a series of sand cuts 23. The sand cuts 23 are longitudinal cuts, having a generally rectangular shape, which reduce the exterior dimensions of the bolt carrier's bearing surfaces 37 when present. If any foreign material, including material resulting from the discharge of a firearm, accumulates within the upper receiver 13, the sand cuts 23 provide an exit for the accumulating debris.

The bolt carrier 20 is further provided with a series of flat surfaces 43 machined onto the forward portion of its exterior. These flat surfaces 43 are present on both the right and left sides of the bolt carrier 20 and machined so that they come to an apex 143. The apex 143 at which point these flat surfaces 43 meet protrudes from the exterior of the bolt carrier 20. These "flats" 43 provide additional space for the accumulation of debris. By providing space and egress points for the accumulation of debris, the static and kinetic friction forces between the bolt carrier 20 and the interior of the upper receiver 13 will not increase as rapidly during prolonged use of the host firearm. Also present is a door opener 28 which provides room for the door latch (not shown) to close.

As best shown in the isolated views in FIGS. 5A-5D, the bolt carrier assembly 10 includes an extension nozzle 50 having an indexing notch 51, a threaded member 52, an opening 53 and a port 54. Once the threaded member 52 of the extension nozzle 50 is properly threaded with the threaded opening 35 in the gas block, the roll pin 31 is inserted through the opening 34 in the gas block 30 and an opening 53 through the extension nozzle thereby rotationally restraining the extension nozzle 50. The purpose of aligning the indexing notches 51 and 33 is to ensure that the port 54 of the extension nozzle 50 is in communication with the port 36 through the gas key 30 (shown in FIG. 8) thereby facilitating the proper operation of the host firearm.

Figure 5A:
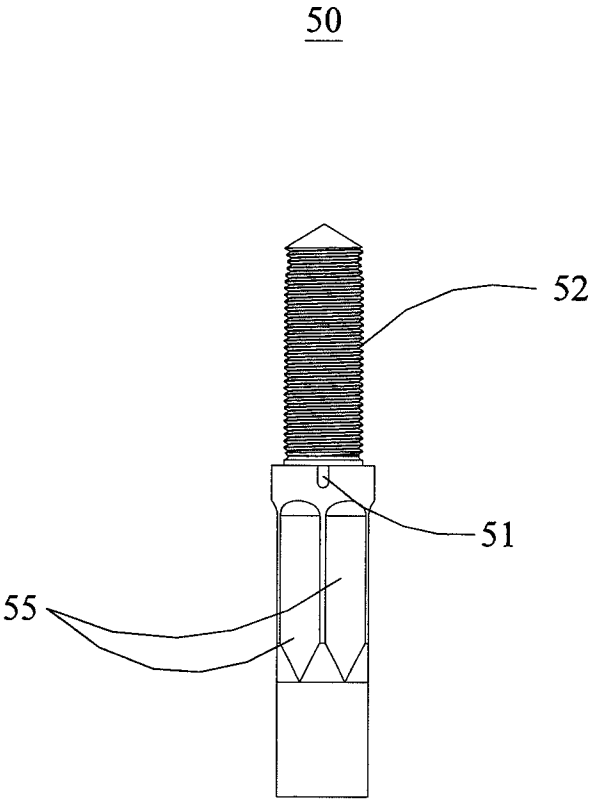
FIG. 5A is a top perspective view of the extension nozzle included in the bolt carrier assembly shown in FIG. 1B.
Figure 5B:
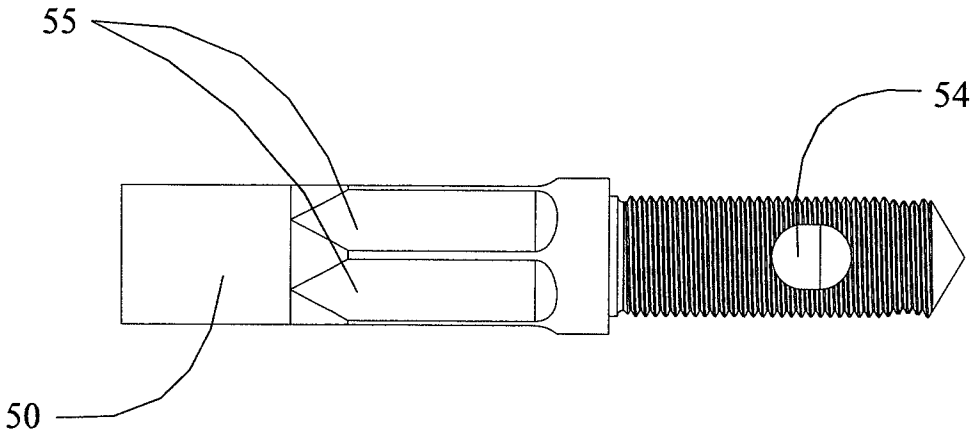
FIG. 5B is a bottom perspective view of the extension nozzle shown in FIG. 5A, with the extension nozzle rotated 180 degrees about its longitudinal axis relative to the view shown in FIG. 5A, making the gas port visible.
Figure 5C:
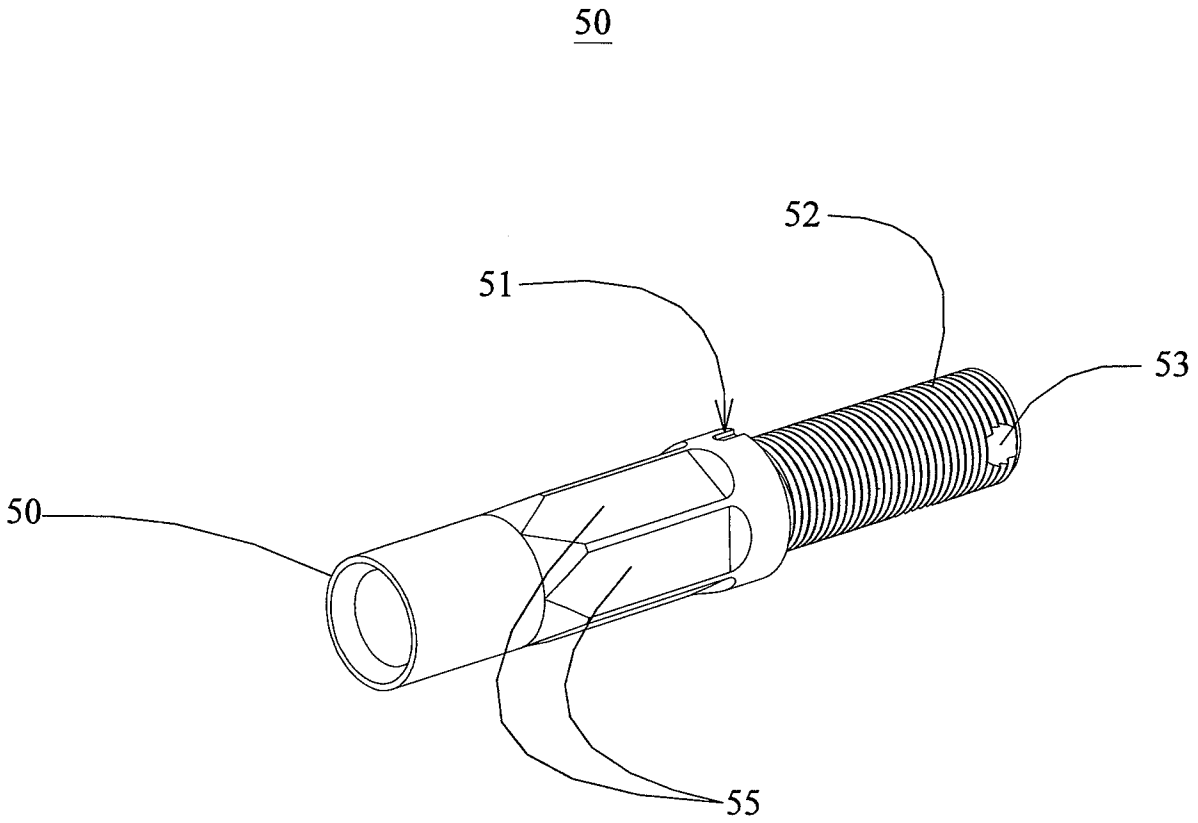
FIG. 5C is a side perspective view of the extension nozzle shown in FIG. 5A with the nozzle rotated 90 degrees from the position shown in FIG. 5B, making the opening for the roll pin visible.
Figure 5D:
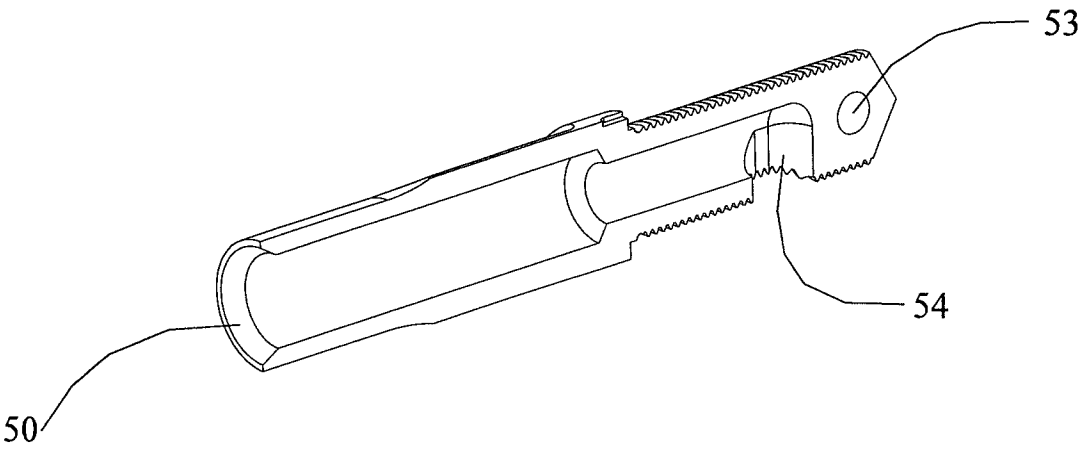
FIG. 5D is a perspective cutaway view of the extension nozzle shown in FIG. 5C, showing the opening through the extension nozzle and the gas port.

More particularly, FIG. 5A is a top perspective view of the extension nozzle is shown in FIG. 5A, with FIG. 5B being a bottom perspective view of the extension nozzle rotated 180 degrees about its longitudinal axis relative to the view shown in FIG. 5A, making the gas port 54 visible. FIG. 5C is a side perspective view of the extension nozzle rotated 90 degrees from the position shown in FIG. 5B, making the opening 53 for the roll pin 31 visible. Finally, FIG. 5D is a perspective cutaway view of the extension nozzle shown in FIG. 5C, showing the opening through the extension nozzle 50 and the gas port 54.

A timing washer 32, which is located between the extension nozzle 50 and the forward face of the gas key 30, may be placed over the threaded member 52 of the extension nozzle 50 and used as a means to orient the extension nozzle 50 when it is threadedly secured to the gas block 30. More particularly, a series of wrench flats 55 are provided about the exterior of the extension nozzle 50 and provide a means by which torque may be applied during installation of the extension nozzle 50. A crescent wrench or a wrench of similar design is used to rotate the nozzle 50 by engaging with the wrench flats 55. When the extension nozzle 50 is being threaded into the gas block 30, the indexing notch 51 of the extension nozzle 50 is aligned with the indexing notch 33 of the gas key 30. The timing washer 32, which allows for a predetermined torque value to be applied, is selected during assembly to facilitate alignment of the two separate indexing marks 33 and 51 and application of the proper torque range. The timing washer 32 is machined from stainless steel but other materials suitable for use in the manufacture of washers would also be acceptable. Alternatively, modern manufacturing techniques and technologies make it possible to time the threads, thereby eliminating the need for a timing washer 32.

Another method of securing the extension nozzle 50 to the gas block 30 includes press fitting them together. This can be achieved by manufacturing an extension nozzle 50 without a threaded member and a gas block which has a non-threaded opening. The threaded portion of the threaded member 53 shown in the illustrated embodiment would be replaced by a smooth exterior, shaped to be received by the non-threaded opening in the gas block. Such a non-threaded extension nozzle would need to be manufactured such that it required substantial force to be pressed into the opening of the gas block. Once pressed into place, the extension nozzle could then be further secured into place through the use of a roll pin such as roll pin 31 or alternatively, welded.

The roll pin 31 used to assist in securing the extension nozzle 50 to the gas key 30 may, alternatively, be replaced with a non-tensioning type (i.e. dowel pin). This solution works because the gas key 30 of the bolt carrier 20 rides in a channel 14 (shown in FIG. 7) within the interior of the upper receiver 13. The location of the gas key 30 within this channel 14 retains the dowel or roll pin because there is insufficient space between the exterior of the gas key 30 and the walls of the channel 14 for the roll pin 31 to fall out.

Figure 6:
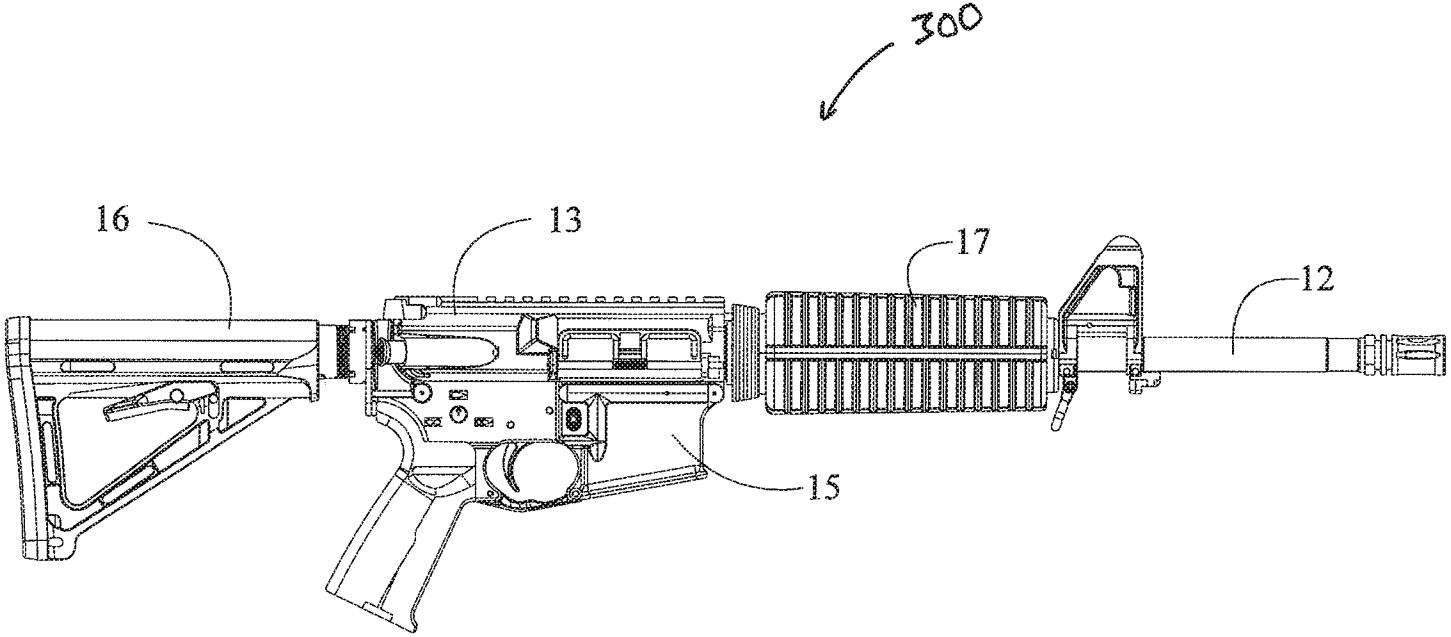
FIG. 6 is a side perspective view of the right side of an M16 type rifle which is operated by direct gas impingement and suitable for use with the bolt carrier in accordance with the present invention.

FIG. 6 illustrates a perspective side view of a direct gas operated rifle 300, generally consisting of an upper receiver group and a lower receiver group. The lower receiver group, well known in the prior art, generally consists of a lower receiver 15 with internal operation control components, a buffer tube and buttstock 16. The upper receiver group generally consists of an upper receiver 13, a barrel 12, and a set of handguards 17, all well known throughout the prior art.

Figure 7:
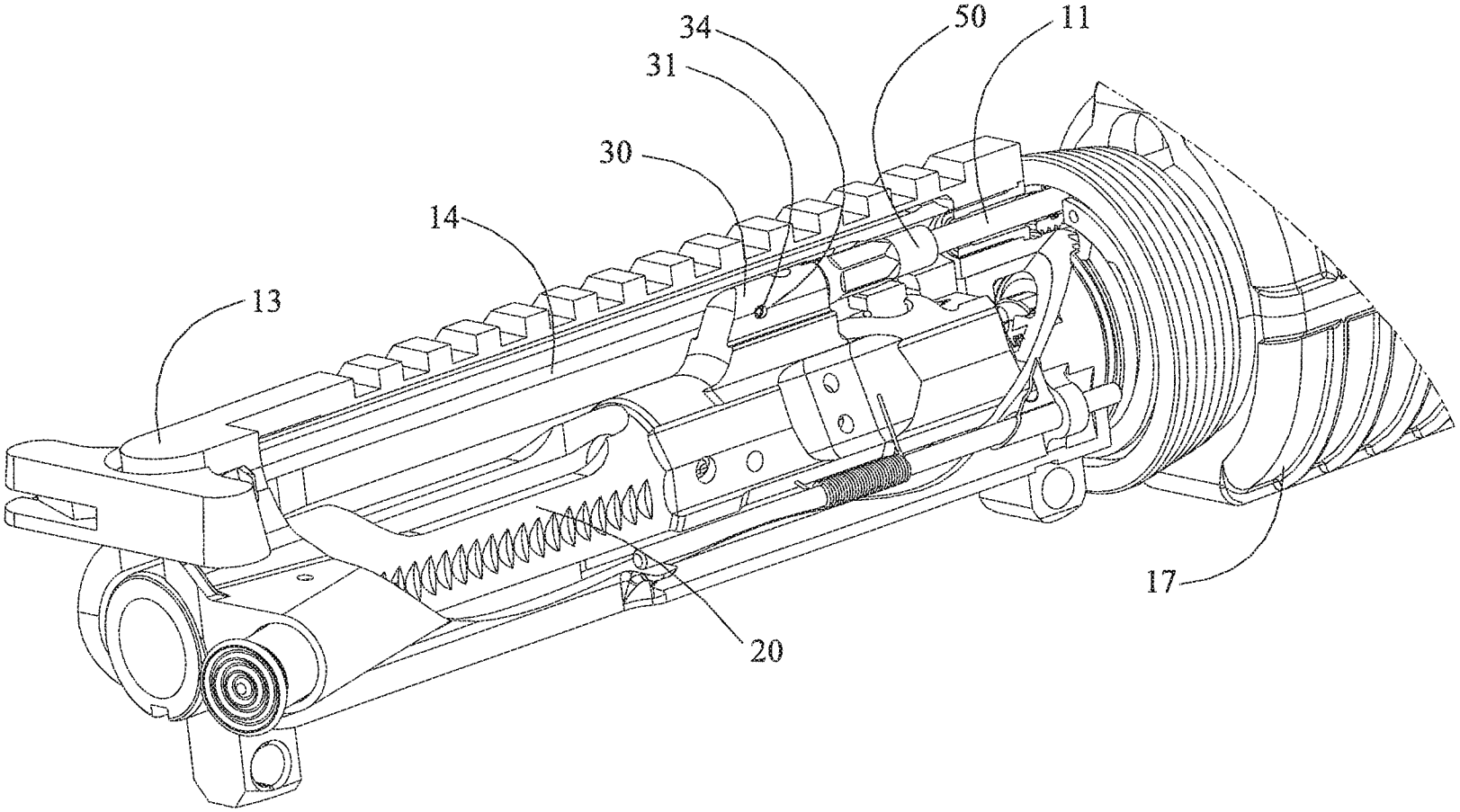
FIG. 7 is a perspective cutaway view of the upper receiver used with the M16 type rifle shown in FIG. 6.

FIG. 7 shows a side cutaway view of the upper receiver 13 in which the channel 14 in which the gas key 30 rides is visible. The channel 14 is generally rectangular in shape and constructed to allow for the longitudinal travel of the gas key 30 and other attached components. The channel 14 is narrow enough to prevent the roll pin 31 holding the extension nozzle 50 from falling out of the opening 34 which is designed to house it. Thus the channel passively assists the roll pin 31 in securing the extension nozzle 50 onto the gas key 30.

Figure 8:
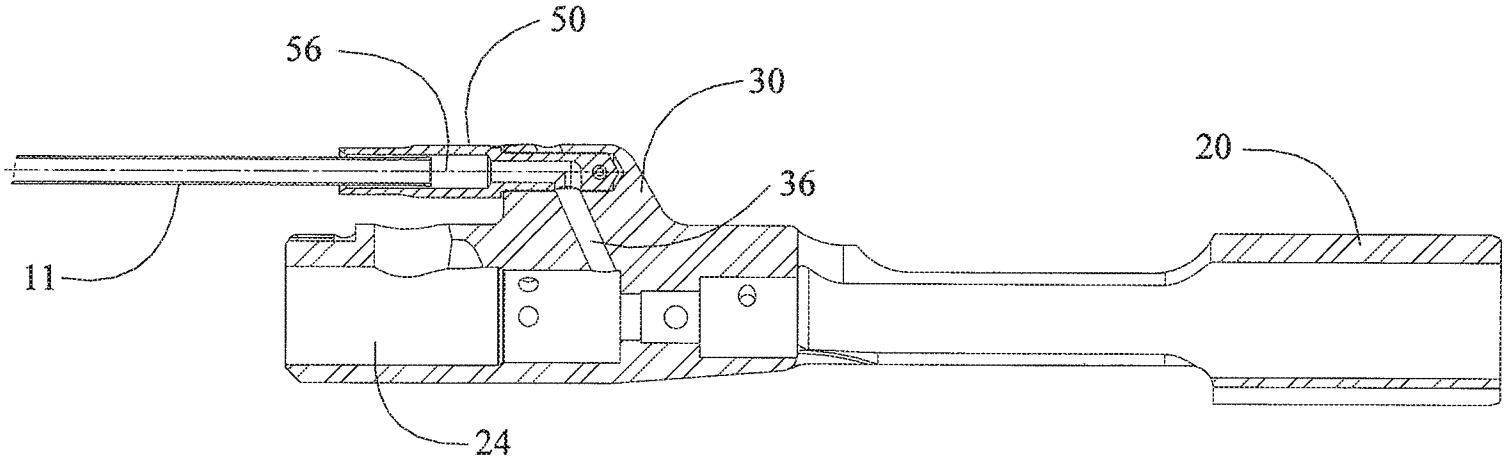
FIG. 8 is a perspective cutaway view of the bolt carrier shown in FIG. 2 along with a portion of a gas tube of the host firearm.

FIG. 8 shows a side cutaway view of the bolt carrier 20 and extension nozzle 50. This view illustrates the gas tube 11 of the host firearm being received by and in operational contact with the opening at the forward end of the extension nozzle 50. In the illustrated embodiment, the opening at the forward end of the extension nozzle 50 has been provided with a 60-degree chamfer to ease its acceptance of the gas tube 11. When the rifle 300 is discharged, gas travels through the gas tube 11 into the opening 56 of the extension nozzle 50, exiting the port 54 (see FIGS. 5B and 5D) located at the rear of the extension nozzle 50, into the port 36 which travels through the gas key 30 arriving at the rear portion of the opening 24, which houses the bolt 21, where the expansion of the gas causes the bolt carrier 20 to move rearward. As the chamber pressure of the barrel 12 decreases, the bolt 21 rotates so that it disengages from the receiver extension of the barrel (not shown) allowing the bolt carrier 20 to move forwardly.

The incorporation of the port 36 through the interior of the bolt carrier 20 is a significant feature related to its manufacture. The bolt carrier 20, in general, is manufactured through the use of lathes and mills to create its general shape along with both its internal and external structures. The bolt carrier may also be cast, with secondary machining operations being performed to bring critical surfaces within the required specifications. After the integral gas block 30 is machined onto the exterior of the bolt carrier 20, a drill press, mill or similar machine is used to machine the opening 42 into the top exterior of the gas block, through to the interior opening 24 for the bolt 21. As previously noted, the resulting port 36 is angled along its length. After the port 36 is drilled, the opening 35 at the forward end of the gas block 30 is threaded to receive the extension nozzle 50.

The bolt 21 of FIG. 1B is shown in greater detail in FIGS. 10-14 and 15A, 15B and 16. The bolt 21 is comprised of an elongated body having a rear end 81 and a front end 82 located along a longitudinal axis. Located about the rear end 81 of the bolt 21 are two circumferential flanges 83 which occupy parallel plains leaving a space, or groove 84, therebetween. The groove 84 is formed to accept a series of gas sealing rings 85. The bolt 21 is formed with a neck portion 86 extending between the annular flanges 83 and the cylindrical body 87. The cylindrical body 87 of the bolt defines a first bore 88 and a second bore 89, both of which extend through the cylindrical body 87 of the bolt 21. In the interior of the bolt 21, there is formed a longitudinal bore 90 which receives the firing pin 29. The cylindrical body 87 also defines an exterior surface 91 thereabout. The face portion 92 of the bolt 21 serves as a cartridge bearing surface 92 and is located near the front end 82. A separate structure but integral feature of the bolt face 92 is the circumferential groove 162 present on the exterior portion of what defines the bolt face 92 (shown in FIGS. 15A and 15B). The circumferential grove 162 is present to facilitate the accumulation of debris incidental to the firing of the associated indirect gas operated rifle 300 (see FIG. 6). In addition, the circumferential groove 162 about the bolt 21 face 92 relives material stress.

The cylindrical body 87 portion of the bolt 21 defines an extractor recess 93. The extractor recess 93, formed on the exterior surface 91, is in communication with the longitudinal bore 90, or firing pin bore. A bearing portion 94 for the extractor 80 resides within the extractor recess 93 and is integrally formed with the body 87 of the bolt 21. The extractor bearing portion 94 of the recess 93 includes a mating surface 96 (see FIG. 13) defining a curved plane substantially parallel to the exterior surface 91 of the bolt 21 such that the face 92 is circular. The underside 95 of the extractor 80 is also curved so that it may engage with and rest against the mating surface 96.

The extractor is shown in FIGS. 15A-15D. The rearward end of the extractor 80 defines a flange 104 which serves as a bearing surface for the extractor springs 101 (see FIG. 10). Located on the flange 104 are two nipples 103 each of which individually engage with a portion of an extractor spring 101.

Figure 14B:
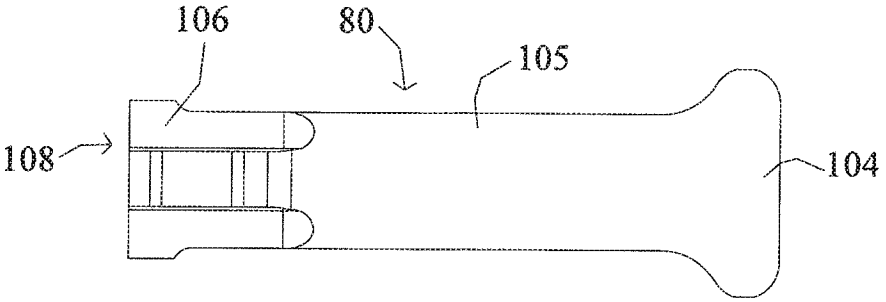
FIG. 14B shows a top perspective view of the extractor shown in FIG. 14A.
Figure 14C:
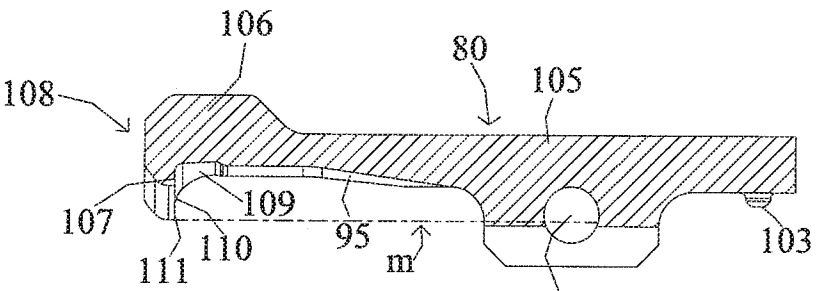
FIG. 14C shows a side cutaway view of the extractor shown in FIG. 14A.
Figure 14D:
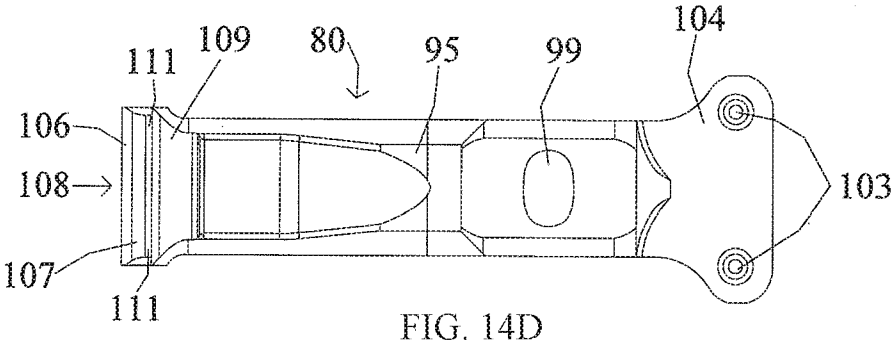
FIG. 14D shows a bottom perspective view of the extractor shown in FIG. 14B.
Figure 14A:
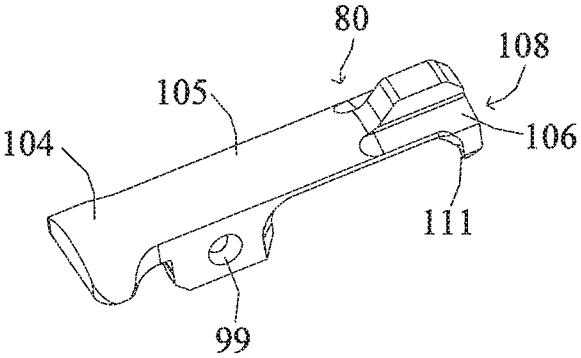
FIG. 14A shows an elevated side view of an extractor for use with the bolt carrier assembly of FIG. 1B in accordance with the present invention.

The extractor body 105 extends between the flange 104 and the extractor claw 106, located on the extractor's forward end 108. The extractor body 105 defines a pin receiving portion 99 along its length. The pin receiving portion 99 is a bore that runs perpendicular to the longitudinal axis of the extractor 80. The extractor claw 106 defines a recess 109 having an upper portion or lip 107. The lip 107 portion of the extractor claw 106 is constructed to engage with the rim of an ammunition cartridge. Structurally, the lip 107 portion of the extractor claw 106 is wider than the extractor body 105. Further, the circumferential edge 110 of the lip 107 comes to two forward edges 111 which are located on opposite sides of the extractor claw 106. The extractor 80 is symmetrical about its longitudinal axis, with FIG. 14C showing a side cutaway view of the extractor along its longitudinal axis. The two forward edges 111 occupy a plane which passes near the approximate center of the longitudinal axis (dashed lines designated by M show this relationship in FIG. 14C) of the pin receiving portion 99. The lip 107 of the extractor 80 removably retains an ammunition cartridge in place within the cartridge recess 98, against the face 92 of the bolt 21.

Prior art extractors used with U.S. military M16/M4 type rifles and their derivatives, grasp approximately 22% or less of an ammunition cartridges rim. An extractor 80 according to the present invention grasps approximately 26% or more of an ammunition cartridge rim. In the preferred embodiment of the present design, the extractor claw 106 grabs approximately 17% more of an ammunition cartridge's rim as compared to the prior art M16/M4 type extractors.

The bore of the extractor's 80 pin receiving portion 99 is configured to align with the second bore 89 of the bolt 21 when the extractor 80 is positioned within the extractor recess 93. A pivot pin 97 is extended through the second bore 89 of the bolt 21 and the pin receiving portion 99 of the extractor to pivotally engage the extractor 80 to the bolt 21. The extractor 80 and thereby its claw 106 are rotatable between a first and second position (not shown). The first position has the lip 107 engaged with the recess of an ammunition cartridge. The second position has the extractor 80 pivotally biased such that the extractor claw 106 is being forced aside during the initial seating of an ammunition cartridge.

The extractor 80 as a unit is constructed to be received within the extractor recess 92 and the extractor gap 144 located on the cylindrical body 87 portion of the bolt 21. The extractor recess 92 and extractor gap 144 are constructed to position the extractor 80 so that its forward end 108 coincides with the front end 82 of the bolt 21.

The cartridge recess 98 is laterally defined by a round side wall 161. The cartridge recess as a whole is defined by the round side wall 161 and the bolt face 92 (shown in FIGS. 10, 15A and 15B). The round side wall 161 is broken up by the extractor gap 144. An ammunition cartridge resides within the cartridge recess 98 such that the case head of the cartridge rests against the face 92 of the bolt 21.

The extractor mating surface 96 defines a portion of the circumference of the face 92 of the bolt 21. In the preferred embodiment, the circumference of the bolt 21 face 92 is circular. In the preferred embodiment of the bolt 21, the face 92 is in direct contact with the entire end portion, or case head, of a retained ammunition cartridge except for the portion which would be over the circumferential groove 162. This method of manufacturing the extractor mating surface 96 and the face 92 does not require material which supports the bolt lugs 142 to be removed thereby compromising their structural integrity.

Referring to FIGS. 11-14, the extractor recess 93 is provided with a pair of spring wells 100. The spring wells 100 are formed in the extractor recess 93 on opposite sides of the longitudinal bore 90 for the firing pin 29. The central axis of each spring well 100 is approximately parallel to the other and is perpendicular to the longitudinal axis of the bolt 21. The spring wells 100 are constructed to receive both a portion of the extractor spring 101 and the spring buffer 102. The spring buffers 102 are manufactured from high temperature resistant VITON® fluoroelastomer, but other high temperature and solvent resistant materials may be used. The buffers 102 help keep the springs 101 in linear alignment with the spring wells 100, prevent distortion of the springs 101, and assist in preventing extractor bounce.

Extractor bounce is a phenomenon whereby the extractor slips off of a seated cartridges rim when the bolt comes under a heightened recoil force generated by the host firearm's discharge, resulting in a failure to extract. When the extractor 80 is engaged to the bolt 21 as previously described above, each one of the nipples 103 on the flange 104 engages a spring 101 while it is housed in a spring well 100. In operation, the springs 101 place pressure on the flange 104 of the extractor 80, thereby pivotally biasing the extractor 80 radially inward. This allows the claw 106 of the extractor to engage the rim of an ammunition cartridge. The springs 101 used for this purpose must also have sufficient flexibility to allow the extractor 80 to pivot radially outward during the recoil cycle so that the ammunition cartridge may be ejected.

Figure 15A:
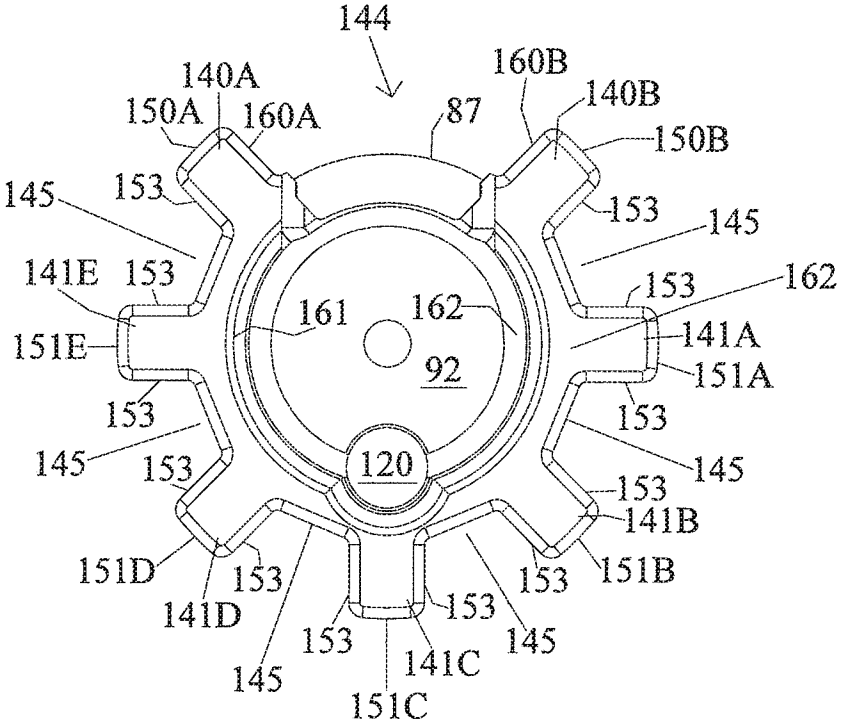
FIG. 15A is a first distal end view of the bolt shown in FIG. 9.
Figure 15B:
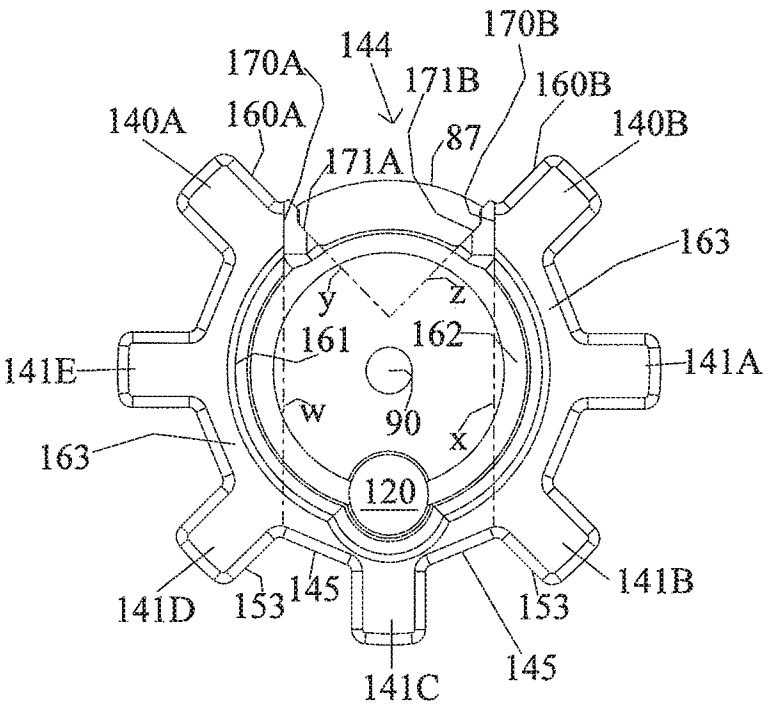
FIG. 15B is a second distal end view of the bolt shown in FIG. 15A with additional reference elements added to clarify structure.

As shown in FIGS. 15A and 15B, seven integral bolt lugs 140A, 140B, 141A, 141B, 141C, 141D, 141E (collectively referred to as "bolt lugs 142") are located adjacent to the front end 82 of the bolt 21 area. Each of the bolt lugs 142 is spaced evenly apart with the exception of lugs 140A and 140B. Each of the bolt lugs 142 radially extend about the longitudinal axis of the bolt 21, adjacent the front end 82. There is a gap 145 located between each pair of bolt lugs 142 with the exception of lugs 140A and 140B. Between lugs 140A and 140B there is defined a gap 144 for the extractor 80. The extractor gap 144 is configured to receive the forward end 108 of the extractor 80 to include the extractor's claw 106 portion.

Each of the bolt lugs 142 defines a corresponding end wall 150A, 150B, 151A, 151B, 151C, 151D and 151E (collectively referred to as "end walls 152") and a pair of side walls 153. At the junction where the side walls 153 meet with at least one of the end walls 153, all sharp angles have been rounded and reinforced with radii removing potential stress risers and concentrators.

In the prior art, bolt lugs 140A and 140B had a portion of the material which would have supported them removed to accommodate the extractor 80 body, a process that is referred to as undercutting the bolt. Additionally, a portion of the bolt's face was removed in order to accommodate the forward end 108 and claw 106 portions of the extractor 80. Structurally, undercutting the bolt constitutes removal of the material under the plane of sidewall 160A of lug 140A and the plane of the sidewall 160B of the lug 140B. This does not apply to the portion of the lugs 140A and 140B which protrudes above the face 92 of the bolt 21.

The preferred embodiment of the bolt 21 as described herein does not rely on removing structural material which would otherwise strengthen the bolt 21. Specifically, lugs 140A and 140B are not undercut by the extractor recess 93. Further, the portion of the extractor gap 144 which accommodates the claw 106 portion of the extractor 80 is wider than the extractor's body 105 and the extractor recess 93. The extractor recess 93 is defined as the relevant area and structural features as set forth above that are located below the horizontal plane defined by the face 92 of the bolt 21. The extractor gap 144 is defined as the relevant opening located above the plane defined by the bolt face 92 and between lugs 140A and 140B of the bolt 21 (shown in FIGS. 15A and 15B). Lug 140A may also be referred to as the first lug and lug 140B may also be referred to as the second lug.

Figure 16:
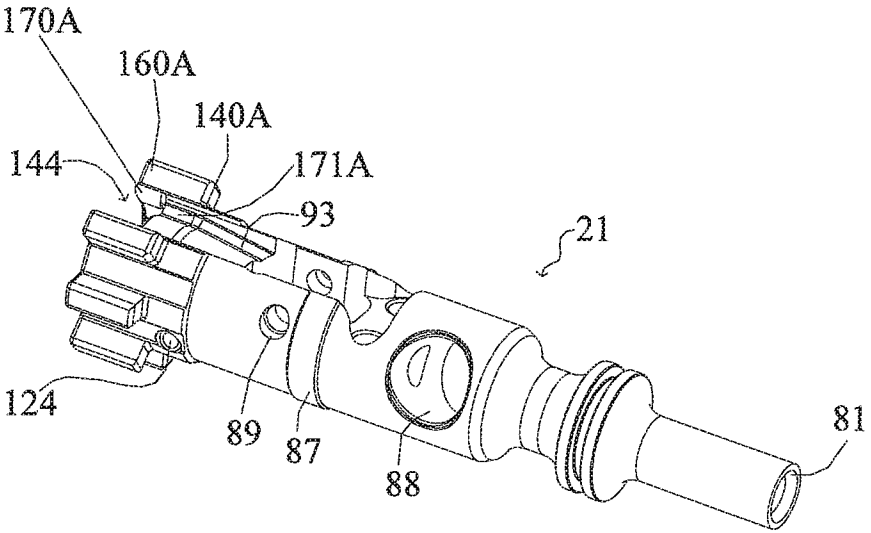
FIG. 16 is a side perspective view of the bolt shown in FIG. 9.

Best shown in FIGS. 15A, 15B and 16 are the side walls which define the extractor gap 144 and extractor recess 93 of the bolt 21. The extractor recess 93 and the extractor gap 144 interrupt the annular structure 163 about the front end 82 of the bolt 21 from which the lugs 142 radially extend. This annular structure 163 is defined as the material between the gaps 145 of the lugs 142 and the round side wall 161 of the cartridge recess 98. At one end, the annular structure 163 terminates into two side walls 170A and 171A. Side wall 170A is adjacent the extractor gap 144 while side wall 171A is adjacent the extractor recess 93. Side wall 170A forms one side of the extractor gap 144 while side wall 171A forms a portion of the side wall which is defined by the extractor recess 93.

At its other end, the annular structure 163 terminates into two side walls 170B and 171B. Side wall 170B is adjacent the extractor gap 144 while side wall 171B is adjacent the extractor recess 93. Side wall 170B forms one side of the extractor gap 144 while side wall 171B forms a portion of the side wall which is defined by the extractor recess 93.

The side wall 171A of the extractor recess is coplanar with the side wall 160A of the first bolt lug 140A. Both side walls 171A and 160A occupy the same plane which is indicated in FIG. 15B by dashed line Y. Side wall 171B is coplanar with the side wall 160B of the second bolt lug 140B. Both side walls 171B and 160B occupy the same plane which is indicated in FIG. 15B by dashed line Z. As shown in FIG. 15B, the planes represented by the dashed lines Y and Z intersect. Side walls 171A and 171B assist in supporting the first bolt lug 140A and the second bolt lug 140B respectively Side walls 170A and 170B occupy parallel planes. Further, side walls 170A and 170B define the width of the extractor gap 144 that is located above the face 92 of the bolt 21. The extractor gap 144 is wider than the extractor recess 93 that is located below the face 92 of the bolt 21.

Side wall 170A lies on a plane which is indicated in FIG. 15B by dashed line W. Side wall 170B lies on a plane which is indicated in FIG. 15B by dashed line X. Neither plane represented by X or W intersects with the other at any point. Further, the plane denoted by X intersects at the approximate junction of side wall 153 of bolt lug 141B and the portion of the annular structure 163 adjacent thereto. The plane defined by W intersects at the approximate junction between the side wall 153 of bolt lug 141D and the portion of the annular structure 163 adjacent thereto.

The bolt 21 of the present invention is turned, machined and precision ground from 9310 steel-alloy bar stock. The bolt 21 is then carburized for case hardness and tempered to increase core toughness. The bolt 21 is steel shot-peened by blasting selected surfaces with steel pellets to induce compressive stresses and improve fatigue life. A coating of nickel with TEFLON®, polytetrafluoroethylene a fluoropolymer, is applied to the bolt 21 to reduce the friction coefficient between the bolt 21 and the bolt carrier 20, and the bolt 21 and the barrel extension (not shown) of the barrel 12.

The bolt carrier 20 is machined from an 8620 steel alloy and carburized or case hardened for wear resistance. A coating comprised of nickel and TEFLON®®, polytetrafluoroethylene a fluoropolymer, is applied to the bolt carrier 20. Electroless Nickel provides wear resistance for the bolt carrier 20 and makes the part easier to clean as carbon and other fouling resulting from the use of the host firearm is easier to remove. The coating also provides the parts with a natural lubricity. Even with the specificity provided above, it should be understood that the entire bolt carrier 20 and bolt 21 of the present invention could be made of conventional materials, preferably hard structural material such as steel or stainless steel and coated with prior art surface finishes such as an electrochemical phosphate conversion coating.

The bolt 21 and bolt carrier 20 of the present invention may be used in conjunction with each other or independently with prior art AR15/M4 bolt carriers or bolts. The method of securing the bolt 21 to the bolt carrier 20 is substantially similar to the methods used in the prior art. Initially the springs 101 and their buffers 102 are inserted into the spring wells 100 located within the extractor recess 93 of the bolt 21. The extractor 80 is placed within the recess 93 so that the two nipples 103 located on its flange 104 are in direct contact with the springs 101. With the pin receiving portion 99 of the extractor 80 aligned with the second bore 89 of the bolt 21, a pivot pin 97 is inserted therethrough to secure the extractor 80 to the bolt 21.

The ejector 120 and spring 122 are received within a bore 121 present on the cylindrical body 87 of the bolt 21, and retained in place through the use of a roll pin 123 as is common throughout the prior art. The roll pin 123 is received in a bore 124 present near the front end 82 of the bolt 21. The gas rings 85 are flexed so that they may be received within the groove 84 present near the rear end 81 of the bolt 21. After the bolt 21 and bolt carrier 20 are assembled as described above, the bolt 21 is inserted into an opening 24 found on the carriers 20 forward end. The first bore 88 of the bolt 21 is oriented so that it aligns with the cam slot 26 of the bolt carrier 20. The cam pin 27 is then inserted through the cam slot 26 and into the first bore 88 of the bolt 21 and rotated so that an opening present along its bottom side is aligned with the bore 39 of the bolt carrier 20, the specifics of which are well known in the prior art. Next the firing pin 29 is inserted through the bore 30 of the bolt carrier 20 and into the longitudinal bore 90 of the bolt 21. The firing pin 29 is secured in placed through the use of a cotter pin 40. The cotter pin 40 is inserted into an opening 41 located on the bolt carrier's exterior and oriented within the opening 41 as described above.

Thus the assembly of the bolt 21 and bolt carrier 20 has been described. By reversing the steps detailed above the bolt carrier 20 and bolt 21 may be disassembled for maintenance and repair as required.

In sum, the present invention provides an improved means for securing a gas nozzle to the bolt carrier of an M16 type rifle. By integrating the gas key 30 onto the bolt carrier 20, the problems associated with the prior art attachment methods are eliminated. By threadedly securing the extension nozzle 50 to the gas key 30 and retaining the extension nozzle 50 in place through the use of a roll pin 31, a superior attachment method is provided. This method of manufacturing a bolt carrier eliminates the extraction and ammunition feeding problems associated with gas leakage linked to the compromised union between the prior art gas key 61 and bolt carrier 60.

The present invention also provides an improved structure on the bolt carrier 20 which orients the cotter pin 40 in a position that optimizes its service life. The opening 41 for the cotter pin 40 holds it in a vertical orientation which places its widest profile towards the back side of the annular flange 44 of firing pin 29. The use of this feature is not limited to rifles using the direct gas operating system seen on the rifle 300 shown in FIG. 6; it is also applicable and appropriate for use with indirect gas operated rifles, commonly referred to as piston operated rifles.

Additionally, there is provided a bolt 21 which provides an extractor recess 93 which does not rely on undercutting the face 92 of the bolt 21 in order to accommodate an extractor 80. Also provided is an extractor which has been designed to grasp at least 26% of an ammunition cartridge's rim.

In an alternate embodiment the extractor's flange 104 could be modified to use a prior art spring and buffer without departing from the significant advantages offered by the herein disclosed apparatus.

In still another alternate embodiment, the bolt face 92 could be machined without the inclusion of the circumferential groove 162.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A bolt carrier for a rifle comprising:

an elongated cylindrical body comprising:

a forward end, a rearward end, a top side, a bottom side, lateral sides, and an internal bore extending from the forward end to the rearward end along a longitudinal axis of the elongated cylindrical body, wherein the internal bore is configured to receive a bolt and a firing pin, a gas key integrally formed on the top side of the elongated cylindrical body;

a removable extension nozzle comprising an open front end configured to receive a gas tube; and a pin, wherein the removable extension nozzle and the gas key are configured to be removably secured together by the pin with the open front end externally to the gas key.

2. The bolt carrier of claim 1, wherein the gas key has a threaded opening about its forward side and the removable extension nozzle has a threaded portion about its rearward end that is sized to be threadedly received by the threaded opening of the gas key.

3. The bolt carrier of claim 1, wherein the removable extension nozzle has a rearward end that is constructed to be secured within the gas key through a press fit.

4. The bolt carrier of claim 1, wherein the gas key comprises:

two gas key openings, wherein the gas key openings are provided in a same spatial location on opposite lateral sides of the gas key and are configured to receive the pin therebetween.

5. The bolt carrier of claim 4, wherein the removable extension nozzle comprises:

two extension nozzle openings, wherein the extension nozzle openings are provided in a same spatial location on opposite lateral sides of the removable extension nozzle and are configured to receive the pin therebetween.

6. The bolt carrier of claim 5, wherein the gas key further comprises:

a gas key indexing notch; and a gas key port throughbore extending from a top exterior surface of the gas key to the internal bore.

7. The bolt carrier of claim 6, wherein the removable extension nozzle further comprises:

an extension nozzle indexing notch; and an extension nozzle port.

8. The bolt carrier of claim 7, wherein when the gas key and the removable extension nozzle are secured together and the gas key indexing notch and the extension nozzle indexing notch align:

(a) the gas key port and the extension nozzle port align providing communication between the extension nozzle and the internal bore, and (b) the gas key openings and the extension nozzle openings align providing the pin to be received through the gas key openings and the extension nozzle openings.

9. The bolt carrier of claim 6, wherein the gas key port is angled along its length.

10. The bolt carrier of claim 1, further comprising:

a retaining pin comprising a head portion and a tail portion, wherein the elongated cylindrical body includes an opening provided on one of the lateral sides perpendicular to the internal bore, and wherein the opening is configured to receive the retaining pin, host the tail portion within the internal bore, and retain the firing pin within the bolt carrier.

11. The bolt carrier of claim 10, wherein the opening is constructed to orient the retaining pin to expose a largest cross section of the tail portion toward an annular flange of the firing pin.

12. The bolt carrier of claim 1, wherein the internal bore comprises a forward end longitudinal bore configured to receive the bolt, and the forward end longitudinal bore comprises two sections of varied diameter, wherein a first section of the forward end longitudinal bore is larger in diameter than a second section of the forward end longitudinal bore, and wherein the first section is configured to accommodate a rearward portion of the bolt, and the second section is configured to accommodate a rear end of the bolt.

13. The bolt carrier of claim 1, wherein the bolt carrier further comprises:

a hammer clearance slot, wherein the hammer clearance slot permits a hammer to extend in the bolt carrier and strike the firing pin;

a charging handle contact point on the top side and immediately adjacent to the forward end; and a cam slot located rearwardly of the charging handle contact point, wherein the cam slot is configured to receive a cam pin, the cam pin being configured to retain the retain the bolt within the bolt carrier, and wherein the cam slot provides a contained area that allows the cam pin to rotate, thereby allowing the bolt to move rearward and rotate axially within the bolt carrier.

14. The bolt carrier of claim 1, wherein the removable extension nozzle comprises:

a series of wrench flats provided about a portion of an exterior of the removable extension nozzle.

15. The bolt carrier of claim 1, further comprising:

a timing washer between the removable extension nozzle and a forward side of the gas key.

16. The bolt carrier of claim 7, further comprising:

a timing washer between the removable extension nozzle and a forward side of the gas key, wherein the timing washer is configured such that, when the gas key and the removable extension nozzle are secured together:

(a) the gas key indexing notch and the extension nozzle indexing notch align;

(b) the gas key port and the extension nozzle port align providing communication between the extension nozzle and the internal bore; and (c) the gas key openings and the extension nozzle openings align providing the pin to be received through the gas key openings and the extension nozzle openings.

17. The bolt carrier of claim 1, wherein the pin comprises a roll pin.

18. The bolt carrier of claim 1, wherein the pin comprises a dowel pin.

19. The bolt carrier of claim 1, wherein the elongated cylindrical body further comprises:

a series of bearing surfaces located on a front half of the elongated cylindrical body, the bearing surfaces being in direct contact with an interior of an upper receiver, wherein the bearing surfaces located along the bottom side of the elongated cylindrical body are interrupted along their length by a series of sand cuts, the sand cuts being longitudinal cuts that reduce exterior dimensions of the bearing surfaces; and a series of flat surfaces machined onto a forward portion of an exterior of the elongated cylindrical body, the flat surfaces being present on both lateral sides of the elongated cylindrical body and machined so that the flat surfaces come to an apex that protrudes from the exterior of the elongated cylindrical body.

20. The bolt carrier of claim 1, wherein the open front end of the removable extension nozzle is provided with a chamfer configured to ease acceptance of the gas tube.

* * * * *